United States Patent [19]

Martin

[11] Patent Number: 4,628,321

[45] Date of Patent: Dec. 9, 1986

[54] APERTURE TRANSFORMATION SIDELOBE CANCELLER

[75] Inventor: Gayle P. Martin, Indialantic, Fla.

[73] Assignee: Harris Corporation, Melbourne, Fla.

[21] Appl. No.: 484,844

[22] Filed: Apr. 14, 1983

Related U.S. Application Data

[63] Continuation of Ser. No. 368,458, Apr. 14, 1982.

[51] Int. Cl.[4] ..... H01J 29/52

[52] U.S. Cl. ..... 342/379; 343/779

[58] Field of Search ..... 343/380, 379, 383, 779

[56] References Cited

U.S. PATENT DOCUMENTS 3,623,094 11/1971 Grabowski et al. ..... 343/779

4,097,866 6/1978 Frost et al. ..... 343/380

FOREIGN PATENT DOCUMENTS 477671 12/1967 Japan ..... 343/779

*Primary Examiner*—Theodore M. Blum

*Attorney, Agent, or Firm*—Antonelli, Terry & Wands

[57] ABSTRACT

An aperture transformation sidelobe canceller includes a plurality of auxiliary feed elements disposed in the vicinity of, but critically offset from, a main feed horn. The signal paths for the auxiliary feed horns are coupled through a low loss cascade RF variable direction coupler network to be combined with the RF signal path for the main antenna feed. The combined signal path is coupled to a performance monitoring processor which, in turn, adjusts the coupling action of each variable directional coupler to achieve the necessary weighting and combining of the auxiliary feed signal paths. The critically offset auxiliary feed elements provide the capability of achieving very broadband and deep nulls from the simple variable directional coupler network. The null availability makes it possible to null the entirety of the main elements sidelobe region, including backlobe and even the first sidelobe region of the antenna pattern, as the offset auxiliary feed horns provide substantial coverage in this region. These offset auxiliary feed elements provide low differential dispersion, require reduced waveguide runs, enjoy polarization diversity by slightly depolarizing and rotating each feed and suffer essentially no grating problems.

49 Claims, 14 Drawing Figures a) SUM POWER vs. $\Theta_0$ WITH $YY^* > X_0 X_0^*$ b) SUM POWER vs. $\Theta_0$ WITH $X_0 X_0^* > YY^*$

APERTURE TRANSFORMATION SIDELOBE CANCELLER

CROSS REFERENCE TO RELATED APPLICATION

This is a continuation application of Ser. No. 368,458 filed Apr. 14, 1982 by Gayle Patrick Martin for Aperture Transformation Sidelobe Canceller.

FIELD OF THE INVENTION

The present invention relates to antenna systems and is particularly directed to a new and improved reflector-type scheme for achieving sidelobe cancellation, through the use of auxiliary horn elements and an associated adaptive signal processing subsystem coupled to the main and auxiliary antenna horn elements.

BACKGROUND OF THE INVENTION

Precise antenna pattern control continues to be a major consideration in communication system design efforts, particularly where the application may require narrow beam focussing or operation in the presence of jamming radiation. For large reflector-type antenna systems, (e.g. Cassegrain antenna systems) the configuration and relative displacement of the antenna components gives rise to a significant sidelobe problem. A conventional proposal to solve this problem has involved the placement of a plurality of low gain auxiliary feed elements around the periphery of the main reflector, with the auxiliary feed elements being coupled through an analog multitap time delay weighting and combining network to be coupled with the signal path for the main feed element. Locating the auxiliary feed elements around the periphery of the main reflector is for the intended purpose of intercepting a variety of diverse signal paths that impinge upon the main horn which contain noise signal components that contribute to the degradation of the main signal of interest lying with the main lobe. Ideally a sufficient number of these auxiliary elements can be readily installed in the edge of the main reflector, so that adequate coverage can be achieved. In addition, the low gain auxiliary elements, individually, do not receive enough of the desired signal to significantly affect tracking circuits or to cause unacceptable dispersion.

Unfortunately, the use of such an auxiliary cancellation array entails two serious drawbacks. The first is a severe differential dispersion effect which itself must be compensated, typically through the use of a multitap weighting and combining network. The second is a substantial grating effect which will not satisfy most large aperture requirements for present day antennas, since it is not possible to null more than a single jammer at any time for certain angles, and at other angles simultaneous jammer nulling cannot be accomplished without excessive degradation of the system signal-to-thermal noise ratio.

For the purpose of signal processing, the RF signals from each of the auxiliary feed elements are fed to a multitap IF weighting and combining network which, by definition, employs attendant down conversion circuitry. Customarily, the down-conversion components for each element include one or more cascaded stages containing local oscillator, preselection filter, low noise amplifier and mixer. Each of the down-converted and filtered auxiliary element outputs is coupled to its own associated multitapped weighting and combining network, with successive taps being coupled through respective I/Q weighting circuits to plural inputs of a dispersive summation device, the output of which represents the "modified" signal for that particular auxiliary feed path. The weights are adjustable by way of respective analog correlation loops for each tap. All of the dispersively weighted and summed auxiliary feed (sidelobe cancellation) waveforms are then combined to provide a "best estimate" of the jamming waveform which is to be cancelled from the main antenna. This estimate is then up-converted to the original RF frequency and coupled to the main antenna feed by way of a directional coupler.

Now, although the signal processing aspects of the auxiliary array serve to compensate for the dispersion effects, they not only do not eliminate the severe grating effects, but they suffer from a number of unfavorable aspects in and of themselves. Because of the number of components involved for each auxiliary feed, the signal processing network is both complex and difficult to maintain. Also, components such as low noise amplifiers, which are extremely sensitive RF components, add considerable cost to this approach. In addition, the preselection filter for the main feed channel cannot be too narrow because of differential phase variations to which the adaptive circuit is sensitive. As a result full jamming is coupled to the preselection filter which creates the possibility of intermodulation problems.

SUMMARY OF THE INVENTION

Rather than attempt to solve the sidelobe problem with a rim-mounted array and multitap weighting and combining network that suffers from the above-described drawbacks, the antenna configuration according to the present invention embodies an arrangement comprised of a plurality of auxiliary feed elements disposed in the vicinity of, but critically offset from, the main feed horn. The signal paths for the auxiliary feed horns are coupled through a low loss cascade RF variable directional coupler network to be combined with the RF signal path for the main antenna feed. The combined signal path is coupled to a performance monitoring processor which, in turn, adjusts the coupling action of each variable directional coupler to achieve the necessary weighting and combining of the auxiliary feed signal paths, Advantageously the critically offset auxiliary feed elements provide the capability of achieving very broadband and deep nulls from the simple variable directional coupler network. The null availability makes it possible to null even the first sidelobe region of the antenna pattern, as the offset auxiliary feed horns provide substantial coverage in this region. These offset auxiliary feed elements provide low differential dispersion, require reduced waveguide runs, enjoy polarization diversity by slightly depolarizing and rotating each feed and suffer essentially no grating problems.

Since the offset auxiliary feed horns provide signals with very low differential dispersion, a simplified amplitude/phase weighting and combining network configured of low cost variable directional couplers, operating at RF frequencies, may be employed. As a result no low noise amplifier or attendant preselection filters are required, thereby reducing the cost and complexity of the processing configuration. As adjustment of the variable directional couplers is achieved by a performance monitoring microprocessor, the signal processing network is adaptive, thereby increasing its accuracy and reliability.

DETAILED DESCRIPTION

Figure 1:
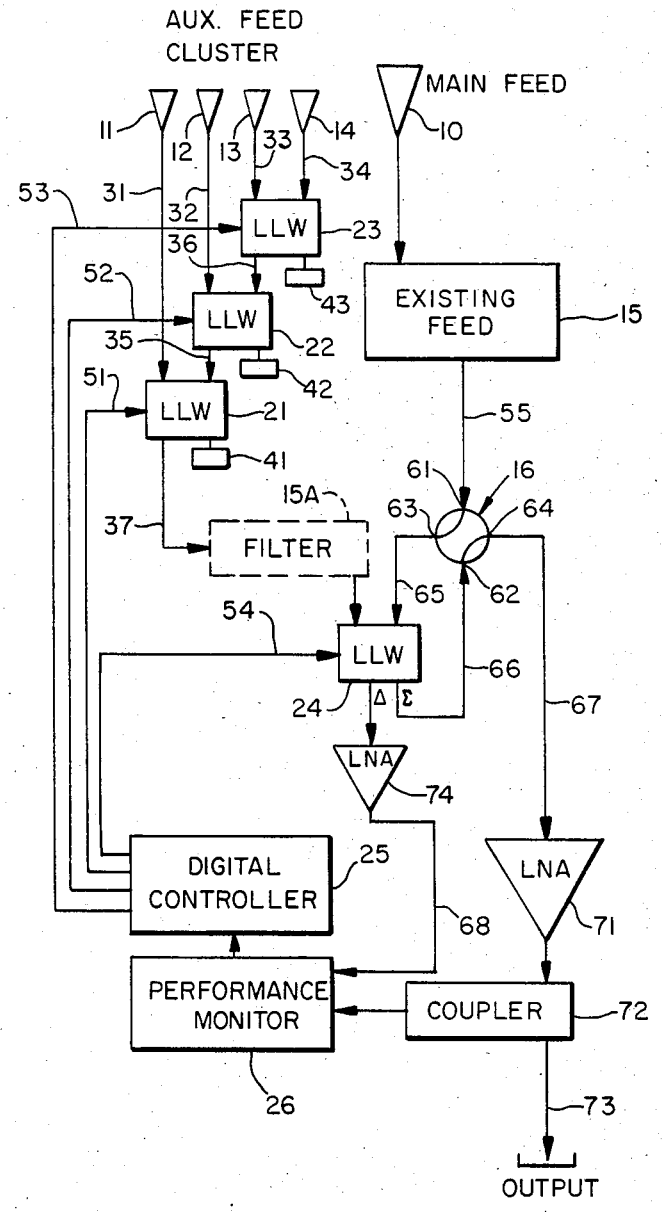
FIG. 1 is a block diagram of an aperture transformation sidelobe canceller in accordance with the present invention.

Referring now to FIG. 1, there is shown a block diagram of the aperture transform sidelobe canceller according to the present invention. The antenna portion of the sidelobe canceller is comprised of a plurality or cluster of auxiliary feed antennas 11, 12, 13 and 14 which are located near the main focus of the reflector (not shown) and are critically offset from the main feed antenna 10. Since elements 11–14 are positioned near the main focus of the reflector, they receive the transformation effect of the reflector just as does the primary feed horn 10. Thus, interference signals which enter the main feed horn 10 also enter the array or cluster of auxiliary feed elements 11–14 in practically the same manner. This permits deep broad band nulls to be obtained with simple IQ type weighting and combining circuits 21, 22 and 23, connected to the outputs of the auxiliary feed elements 11–14 as will be described in detail below. Moreover, the entire $4\pi$ sterradian angular space of the antenna can be covered, because far side lobes and back lobes of the main antenna 10 are established similarly in the array of auxiliary elements 11–14.

As pointed out previously, and as will be described in greater detail below, another important aspect of the cluster of auxiliary feed elements 11–14 is the absence of grating effects. The conventional approach for obtaining sidelobe cancellation is to rim-mount the auxiliary elements or other configurations employing widely spaced auxiliary elements. Unfortunately, this scheme suffers from poor coverage and excessive dispersion (thus limiting the null depth and coverage regions). Also, the wide spacing of the conventional auxiliary array produces a substantial grating lobe situation which can prevent simultaneous nulling of multiple jamming. In contrast, in accordance with the present invention, by disposing the auxiliary feed cluster 11–14 closely spaced but critically offset from the main antenna feed element 10, the grating effect is circumvented. This clustering and critical offset positioning will be described in detail below with reference to FIGS. 2, 2A and 3.

For coupling the array of auxiliary elements 11–14 to downstream signal processing circuitry, short runs of wave guide 31, 32, 33, and 34 are employed, the wave guides feeding low-loss cascade weighting network devices 21, 22 and 23, operating RF frequencies. Because of these low loss combining circuits, no RF amplification, up-conversion, down conversion, etc. is necessary. If there is a diplexing filter in the existing feed 15 for the main antenna element 10, a similar filter as shown in broken line form at 15A, must be placed in the output path from the cascaded weighting network devices 21, 22 and 23 in order to insure that similar differential dispersion exists in both paths, thereby enhancing the capability of the system to obtain deep nulls.

As pointed out previously, the low loss weighting and combining cascade network comprised of devices 21, 22 and 23 is an entirely passive RF network having no low noise amplifiers or preselect filters. Absence of these conventional components is possible because of the minimum loss properties of the weighting and combining network. Specifically, the low loss weights may consist of variable directional couplers made of magic Ts and ferrite phase shifters to be described below; such phase shifters have a nominal insertion loss of about 0.2 dB. No desired power is wasted with such a low loss network, although undesired power is dumped in difference port attenuators 41, 42 and 43 connected to the difference outputs of respective elements 21, 22 and 23. As pointed out above, if a diplexing filter is employed in the existing feed 15, a corresponding diplexing filter **15*a* is connected in the signal path 37 coupled to the output of network 21 and one of the input ports to the a further low loss weighting and combining network 24. For coupling the existing feed either to low loss weighting and combining network 24 for combination with the outputs of the auxiliary feed cluster 11–14 or without the benefit of sidelobe cancellation properties of the present invention, a quickly changeable waveguide switch 16 is employed. In its present position, output link 55 from the existing feed 15 is coupled to an input 61 which feeds an output 63 of switch 16. The output 63 is coupled over line 65 to one input port of low loss weighting and combining network 24. The other ports 62 and 64 of switch 16 are coupled to lines 66 and 67, thereby coupling an output of low loss weighting and combining network 24 to a downstream low noise amplifier 71. Low noise amplifier 71 is not subjected to the maximum jamming signals which are incident on the antenna because of the above-described combining network and the noise figure penalty associated with this connection is very slight, in the absence of jamming being only about 0.4 dB, and near 0 dB with the wave guide switch 16 rotated counter clockwise 90° to its bypass position whereby port 64 couples the signals on input link 55 to output port 62 and link 67 to low noise amplifier 71**.

Each of the low loss weight elements 21, 22, 23 and 24 has a control input connected to a respective one of control lines 51, 52, 53 and 54 which supply control signals from a processor-based digital controller 25. Controller 25 is coupled to a performance monitor 26 which, via a coupler 72 disposed in the output line 73 from low noise amplifier 71, provides a measure of the signal derived from the main feed and, depending upon the position of changeable waveguide switch 16, from the combination of the main feed signal path and the auxiliary cluster network. The operation of controller 25 and performance monitor 26 including the control algorithm for adjusting the components of the network will be described in detail below. For purposes of the present description, it is sufficient to observe that the summation port power derived from low loss weighting combining network 24 is coupled through waveguide switch 16 to the system low noise amplifier 71 and thereon to downstream system receivers and modems via link 73.

Performance monitor 26 and digital controller 25 optimize the system signal-to-noise ratio by monitoring the signal over link 73 via coupler 72. Digital controller 25 carries out calculations in accordance with the algorithm to be described in detail below and provides a set of control signals over lines 51–54 to adjust the low loss weighting and combining network drivers through a set of respective D-A converters (not shown, but included within the controller 25) via signals lines 51–54. Advantageously, in accordance with the present invention, the algorithm employed by the controller 25 is adaptive and the sum port output becomes optimized, with the difference port output containing nearly 2J, where J is the sum of the interference power incident on the main feed. As a result, by monitoring the output port of low loss weighting and combining network 24, via downstream coupler 72, it is possible for the processor to determine qualitatively as well as quantitatively the amount of jamming present in the antenna input. Another significant aspect of this approach is that the adaptive algorithm process can be completely normalized and, consequently, become completely insensitive to dynamic power variations (jammers at the maximum input power level are nulled at the same rate and equally effective as jammers approaching the lower end of the systems sensitivity).

Figure 2:
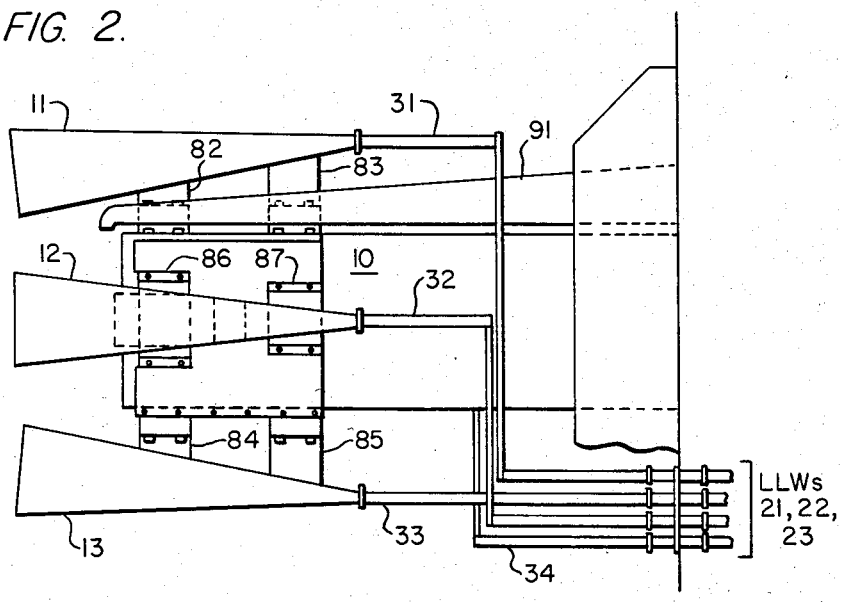
FIG. 2 is a side view of the structural positioning of the auxiliary and main feed forms in the system of FIG. 1.
Figure 2A:
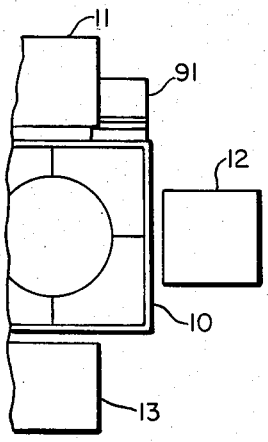
FIG. 2A is a partial head-on view of the feed horn configuration of FIG. 2.

Referring now to FIG. 2, an exemplary structural mounting configuration for the auxiliary feed cluster comprising antenna feed elements 11, 12, 13 and 14 critically offset from and surrounding the main feed horn 10 is illustrated. Attention may also be directed to FIG. 2*a* which shows a partial front view of the configuration shown in FIG. 2, illustrating antenna feed horn 12 and part of each upper and lower elements 11 and 13 which surround the main feed 10. Upper element 11 may be supported on the main feed 10 by way of a pair of brackets 82 and 83 and an upper support arm 91, while lower auxiliary element is physically attached to the main feed 10 by a pair of brackets 84 and 85. Similarly, a pair of brackets 86 and 87 are provided to support elements 12 at the side of the feed horn 10. Another pair of brackets (not shown) is provided for non-illustrated auxiliary feed horn 14. These brackets support each of the elements in an asymmetrical cluster around the main feed horn 10. The outputs of the auxiliary feed horns are coupled through links 31, 32, 33 and 34, respectively, to the low loss weighting and combining networks 21, 22 and 23 referenced previously in conjunction with the description of FIG. 1 and described in detail below. As explained previously, auxiliary feed horns 11, 12, 13 and 14 are "critically offset" to provide the capability of achieving very broadband and deep nulls with the use of the simple weighting and combining networks 21, 22 and 23. The phrase "critically offset" relative to the disposition of feed elements 11–14 means that the feed elements are positioned with respect to the optics of the reflector and any subreflectors, if present, so that the feed element's radiation pattern has a response tailored to the system level problem being addressed. In the exemplary configuration shown in FIG. 2, the horns are disposed fairly close to, but still spaced apart from, the main reflector 10 and advanced relative to its positon as spaced apart from the subreflector, such as in a Cassegrain antenna arrangement. To illustrate the manner in which the positioning of the auxiliary antenna feed elements is determined, attention is directed to FIG. 3 which shows, schematically, the positioning of the main feed horn 10 and one of the auxiliary feed horns 11 and the resulting pattern produced thereby.

Figure 3:
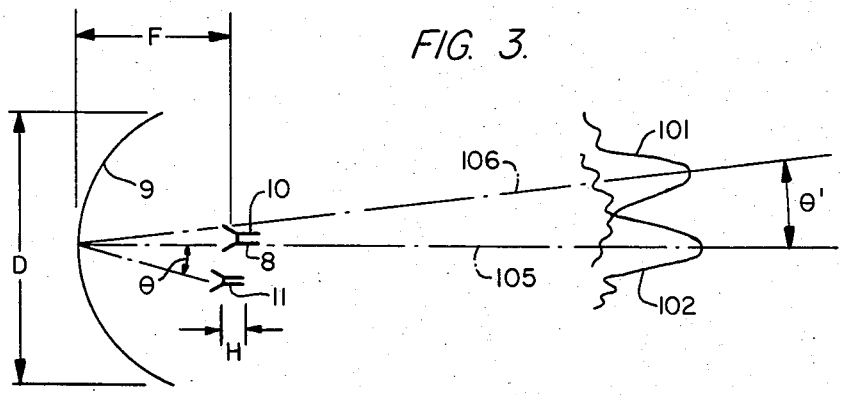
FIG. 3 is a diagrammatic illustration of positioning of the principal and auxiliary feed horns and their attendant response patterns.

Considering, first of all, a sidelobe-only adaptive canceller, sidelobe cancellation may be facilitated if the desired signal is received significantly by only the main feed element 10. Simultaneously, interferrence signals should be readily received by the remaining auxiliary elements 11–14 in order that the cancellation process does not significantly degrade the desired signal-to-thermal noise ratio. Collectively, this means that the auxiliary element patterns must have broad nulls in the region of the main beam and high sidelobes with relatively shallow nulls in the remainder of the covered space. As shown in FIG. 3, the main feed element 10 is typically positioned at the focal point 8 of the reflector optics, resulting in a well defined main beam relative boresight to axis 105. For a circular aperture, the resultant pattern may be defined as the first zero of the Bessel function $J_1$ (kD sin $\theta$) fork$=2\pi/\lambda$, where $\lambda$ is wavelength, D is aperture diameter and $\theta$ is the elevation angle measured from the boresight 105.

If a feed element, such as element 11, is displaced from the reflector optical focal point 8, the resultant radiation pattern is displaced along a far-field pointing angle axis 10. There is an associated gain reduction and the filling in of pattern nulls. The angular displacement of the far-field pattern (beam and nulls) is approximately equal to the angular displacement of the feed horn from the optical axis 105.

In order to obtain an auxiliary element pattern which has negligible response throughout the beam of main element 10, and not just precisely on-axis, a two-step analysis using the beam pattern diagram and the horn arrangement shown in FIG. 3 for a prime feed optics is employed. Other optics such as Cassegrain or Gregorian apply equally. First of all, the auxiliary feed 11 is displaced at an angle $\theta$ from the optical axis 105 which results in the pattern displacement from the main beam by an angle $\theta'$ along axis 106. $\theta$ and $\theta'$ may be expressed in terms of one another by a "beam factor" which is approximately equal to 1 and is well known. For more detailed explanation of beam factor relationship, attention may be directed to "Antenna Engineering Handbook" by Jasik chapter 15, section 5, published by McGraw Hill.

A very accurate beam displacement, as well as total pattern coverage prediction may be obtained through the use of computer-aided analysis tools such as the "Geometric Theory of Defraction". A satisfactory value of $\theta$ is obtained if the displaced pattern 101 falls near the second sidelobe peak of the main pattern 102. This causes the displaced second sidelobe region of the auxiliary feed horn 11 to fall near the peak of the main beam response pattern 102. In addition, phasing and illumination errors caused by the displacement of the auxiliary feed horn 11 simultaneously cause the sidelobe region in the direction to which the displaced beam pattern 101 is pointed along axis 106 to increase substantially, while the sidelobe nearest the optical axis and thus in the vicinity of the system's main beam pattern 102 is greatly reduced. This effect is well known and although it undersirable in some beam scanning applications, it is precisely the effect needed for effective sidelobe cancellation. The reduced response region along axis 105 will have gain and null sharpness dependent upon the reflector's F/D, where F is the distance between the focal point defining the position of the main feed horn 10 at focal point 8 and the reflector 9, while D is the diameter of the reflector 9, as shown in FIG. 3.

A broad minimum will result, and pattern nulls throughout the entire coverage of the auxiliary feed horn 11 will be filled when step 2, corresponding to displacement of the feed by an amount H in the direction of the optical axis, is applied. This adjustment considerably defocuses element 11, thereby eliminating deep nulls and increasing far sidelobe levels over the entire main beam space (both of which are desirable from a standpoint of the auxiliary cancellation pattern). A satisfactory displacement distance H is usually one or two wavelengths with optimal placement determined either experimentally or with computer aided analysis such as through the use of geometric theory of defraction.

The pattern of the auxiliary horn 11 provides a desired excess of gain largely in the guadrant to which its main beam is displaced. Full coverage is obtained through the use of additional auxiliary elements, each also critically positioned, but displaced in azimuth around the main beam. The total number of elements required is a function of adaptive degrees of freedom required, as well as excess coverage gain (which determines minimal desired signal-to-thermal noise degradation).

In the embodiment illustrated in FIGS. 1 and 2, four such elements are employed for complete near-in coverage. Other auxiliary horns may be displaced even further from the main optical axis providing coverage further out. Ordinary scanning considerations which are well known will apply and limit placement of the auxiliary beams within about 10 beam widths of the optical axis.

Once full coverage has been obtained, additional auxiliary feed elements will be required only for providing additional degrees of freedom suitable for the simultaneous nulling of a large number of interfering sources. The enhanced sidelobe levels of the displaced auxiliary elements provide satisfactory coverage of the main elements sidelobe region over the entire space and additional elements are not needed for simple coverage enhancement.

A second example of the critical offset placement of the auxiliary elements embodies a system which requires main beam as well as sidelobe region cancellation. In this embodiment, critically placed auxiliary elements must be provided to cover not only the sidelobe regions but also the main beam lobe regions as well. In such as case, the more or less orthogonal coverage properties of the plurality of feed horns as used in the sidelobe canceller are retained for general sidelobe coverage. Main beam coverage is obtained with closely spaced auxiliary elements in exactly the same manner as in well known "pseudo monopulse tracking systems.

In connection with the illustration of the feed horn elements 11–14 in the configuration shown in FIG. 2, above, the sidelobe cancelling elements are shown as pyramidal horns. However, circular horns corresponding to the antenna with which the sidelobe cancelling auxiliary horns mate may be selected after the pattern distribution performance has been fully evaluated. In either case, the horns usually have gains that are within 3 dB of the existing feed and will be aimed toward the subreflector to balance coverage in the spillover regions, as explained above. Moreover, as noted above, only forward-looking elements are required for complete spacial coverage, rearward facing elements being unnecessary because rim currents are set up around the subreflector and the main reflector in an identical manner to the currents excited by the primary feed horn 10.

Figure 4:
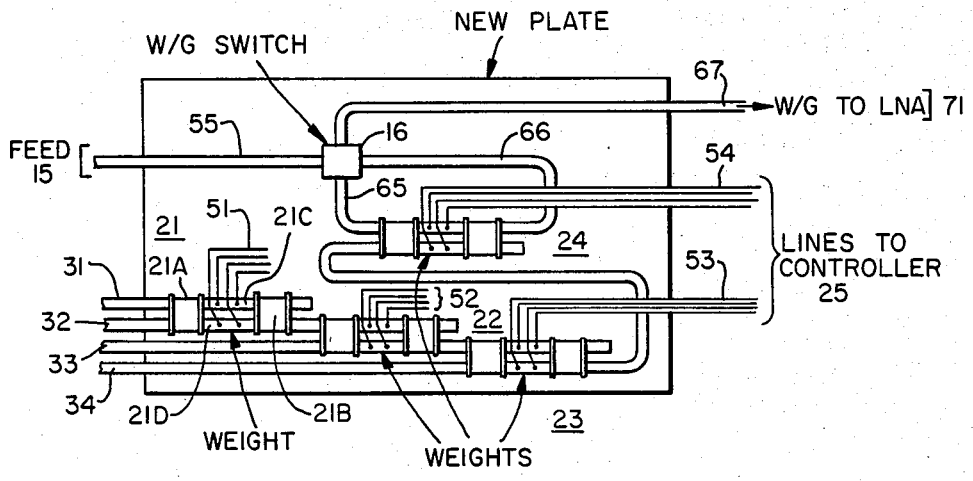
FIG. 4 shows an exemplary arrangement of the physical mounting within the antenna structure of signal processing components of FIG. 1.

As pointed out previously, the outputs of the auxiliary feed horns 11–14 are coupled to an arrangement of low loss weighting and combining networks 21, 22 and 23, the existing feed and the auxiliary feeds then being combined by way of a fourth low loss weighting and combining network 24. Advantageously, because these components are passive and compact, they may be mounted on the antenna structure in a manner such as shown in FIG. 4. As illustrated in FIG. 4, each weighting and combining network consists of a pair of infinitely variable 360° ferrite phase shifters placed between a matched set of magic Ts or hybrids. In the drawing, these components have been specifically identified for network 21. Namely, low loss weighting and combining network 21 includes ferrite phase shifters 21C and 21D disposed between a pair of magic Ts 21A and 21B. Control lines 51 comprise two pairs of lines, one for each of the ferrite phase shifters 21C and 21D. This weighting system, using conventional hardware ferrite phase shifter components, modifies the phase of any signal from 0° to 360°, the amplitude from a minimum insertion loss of 0.5 dB to 45 dB, or any combination within this range.

As will be explained in greater detail below, the basic operation of the phase shifter depends upon a pair of control fields, one being a sine component and the other being a cosine component, which shift and stabilize the state of the ferrite material. Because the loads on the control fields are very inductive, the control timing is slower for the initial steps, but decreases as step size diminishes, ultimately requiring only a few microseconds. Drivers which supply control fields to the phase shifters respond to the digital outputs from the digital controller 25, with separate digital-to-analog converter components being employed for each of the digital control lines to supply the necessary analog voltage for the phase shifter.

Figure 5:
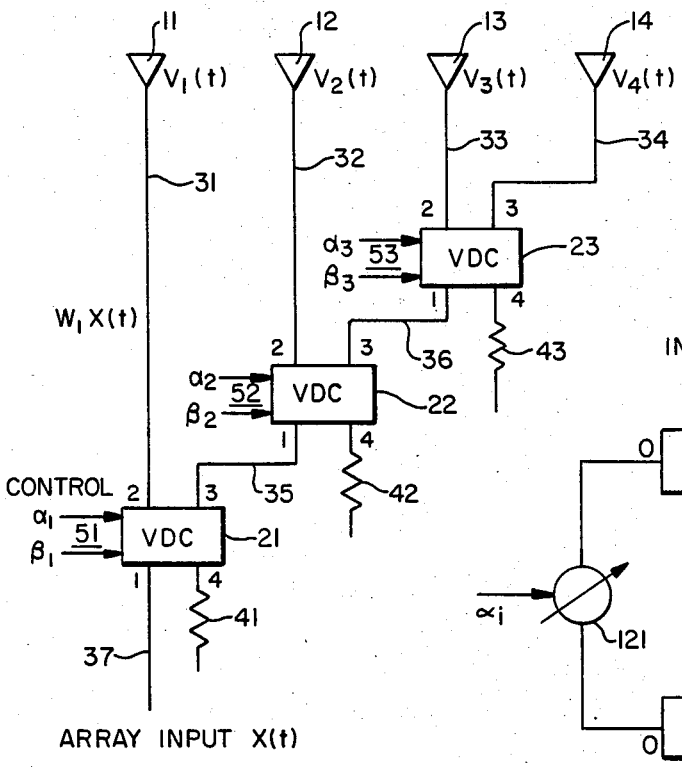
FIG. 5 is a block diagram of the cluster of auxiliary feed elements and associated low-loss weighting and combining variable directional couplers for the auxiliary subsystem of FIG. 1.

For an understanding of the manner in which the performance monitor 26 and digital processor 25 monitor the combined signal on lines 67 and 68 adjust the action of the low loss weighting and combining networds, the following discussion will treat the action imparted by and the control of an array of low loss weighting and combining elements such as components 21, 22 and 23 coupled to the respective auxiliary feed horns 11–14 of the configuration shown in FIG. 1. FIG. 5 illustrates the feed horns and the weighting networks individually, and the detailed explanation to follow will make reference to FIG. 5 and subsequent Figures for purposes of amplifying the description and understanding of the use of such networks.

As pointed out previously, the low loss weighting and combining networks are employed for adaptive nulling the resulting antenna pattern as desired. The processor 25, which controls the action of the individual networks, operates in accordance with a cascade control algorithm which utilizes a pair of control procedures, herein after referred to as a ratio gradient and an amplitude phase search. The combined process optimizes specified weight control parameters for achieving a maximization of the signal-to-noise ratio of desired signal terms. Both adaptation techniques operate on the basis of array output measurements and require neither measurement of individual antenna elements nor coherent channels. Thus, the output power coupled over link 67 is all that is needed for the processor 25 to make its evaluation and supply control signals to the individual weights 21–24.

The ratio gradient algorithm employs a modified gradient in conjunction with several analytic expressions, so as to locally optimize the weight-combining process between the main channel 55 (from feed 15) and the summation channel 37 (from cascaded devices 21–23). The optimization of these parameters is facilitated with a simultaneous measurement of the sum and difference power at the injection combiner, namely the last combiner in the cascade network (device 24 in FIG. 1), with associated control parameters $\theta_0$ and $\theta_1$ to be described in detail below. These measurements are formed into a ratio or modified gradient which minimizes jammer modulation effects in the calculation of the primary weight control parameters. In general, this results in a large reduction in a number of samples (or integration time) required for processor 25 to estimate useful gradient terms.

The amplitude-phase search constitutes a gradient-based algorithm which sequentially perturbs the upper variable directional couplers by applying a small amplitude or phase dither to each weight. The resultant change in array output power supplied over line 67 is then used to modify the individual weights 21–24 in such a way as to reduce jammer interference. However, several computational cycles are necessary in order to obtain a estimate of the output power when sensing the effect of amplitude or phase perturbations. As a result, the computational time of the processor 25 becomes an important factor when determining the null formation capabilities of the composite system.

Referring now to FIG. 5, the individual low loss weighting and combining networks are illustrated as comprising respective variable directional couplers (VDCs) each having a pair of input ports 2 and 3 and a pair of sum and difference output ports 4 and 1, respectively.

As pointed out previously, in conjunction with the description of the prior art, the weight requirements of an adaptive array for microwave applications have normally been satisfied by using attenuator and phase shifter weighting devices. However, both types of weighting devices experience some degree of signal attenuation (phase shifters have accumulative loss from the natural bit selection process), and require the added complexities/cost of RF gain amplification requiring, in each channel, low noise amplifier components. In particular, signal attentuation experienced by attentuator weighting devices can be attributed to the sum/difference hybrids (a combined loss of approximately 7 dB is typical) and insertion losses from the bi-phase attenuators (typical insertion loss estimates are about 4 dB). Furthermore, and very importantly, excluding fortuitous phasing conditions (equal weighting of all inputs with cophasing of desired signal terms), significant amounts of energy will be lost in the sum and difference ports of the hybrids. For example, if an optimum solution called for a single antenna element to be selected and all others to be de-selected it can be seen that for an array of four elements, only one-fourth of the selected element's signal would reach the output summing port.

In contrast, if directional couplers having variable coupling coefficients were used in place of the sum and difference hybrids in conventional weighting devices, then no unnecessary power loss would be required. In the arrangement shown in FIG. 5, the energy input into one port of a variable directional coupler divides between the second and third ports according to the control adjustment applied to each of the scaler voltage $\alpha_i$ and $\beta_i$. Complex (i.e. amplitude and phase) adjustment of the effective weight applied to a selective voltage is carried out. If the effective weight setting is $\omega = a\text{-}e^{J\phi+\pi/2})$ and the input voltage is $x(t) = be^{J\psi}$ the output of port 2 will be $\omega x(t)$. The remainder of the incident energy is delivered to port three whose output is $(1-a^2)^{\frac{1}{2}}be^{J\phi+\psi}$. No power will appear at port 4 unless there are reflections in the lines leading away from ports 2 and 3. Consequently, no power is wasted by such a variable directional coupler, although calculation of the required control parameters is more difficult than for a corresponding attenuator and phase shifting device as customarily employed in conventional weighting arrays.

The weighting scheme shown in FIG. 5 and employed in accordance with the present invention is capable of generating any complex weight value less than unity, i.e. $|w| \leqq 1$. Thus, it is no less general than conventional attenuator-type weights. The primary advantage of the variable directional coupler approach is that it can be set for near zero attenuation in contrast to an attenuator type weight which may have as much as 10 dB attenuation in its maximum weight setting condition.

Figure 6:
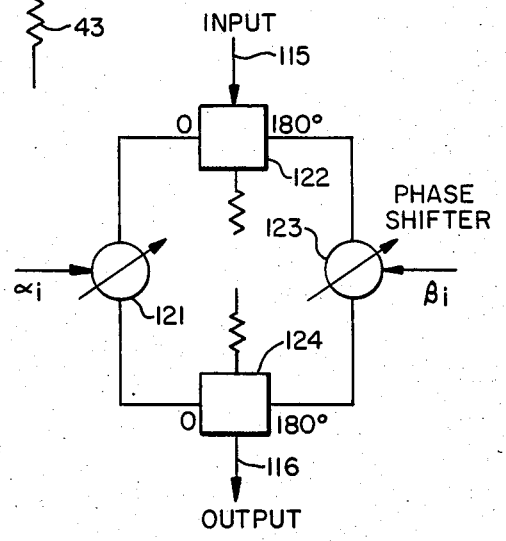
FIG. 6 schematically illustrates the phase-shifter/-magic-T components of an individual variable directional coupler.
Figure 7:
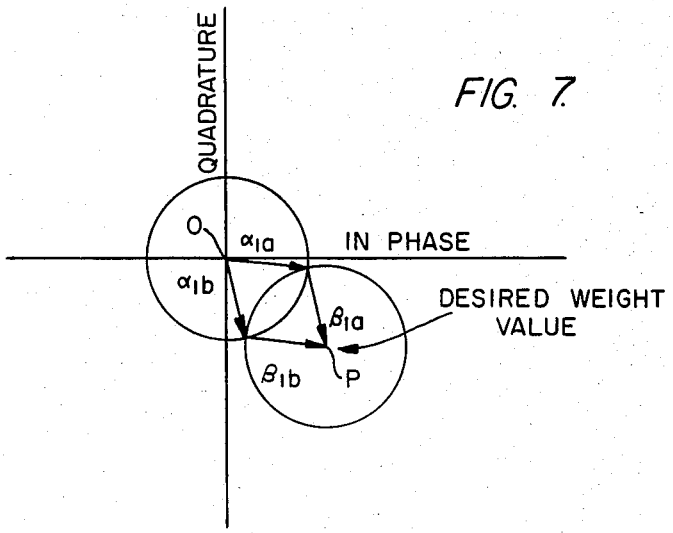
FIG. 7 is a complex phasor diagram representing the action of the device of FIG. 6.

FIGS. 6 and 7, respectively, show a circuit diagram and a phasor diagram for a variable directional coupler weight used as a low loss weighting and combining network in the aperture transformation sidelobe canceller pursuant to the present invention. FIG. 6 showns an input, coupled over a signal line 115 to be weighted, being supplied to a power dividing hybrid 122. Hybrid 122 splits the input signals into in-phase and out-of-phase components and supplies these to a pair of phase shifters 121 and 123 to which respective control inputs $\alpha_i$ and $\beta_i$ are applied. The control lines for these respective phase shifters correspond to control lines for the variable directional couplers shown in FIG. 5, discussed above. The voltage applied over each control line determines the phase shift imparted by the respect phase shifter. The output of the phase shifters are then supplied to a further hybrid element 124 to produce a resultant weighted output one line 116. As explained briefly above, in conjunction with the description of the overall element layout configuration shown in FIG. 4, phase shifters 121 and 123 may constitute respective ferrite shifters disposed between a pair of magic Ts for the dividing and combining power hybrids.

The phasor diagram shown in FIG. 7 illustrates how the variable coefficient directional coupler achieves the desired complex weight setting. A point P in the fourth guadrant of the complex plane is selected as the desired weight value. Inspecction of the phase diagram shows that either $\alpha_{1a}+\beta_{1a}$ or $\alpha_{1b}+\beta_{1b}$ can achieve the desired value at point P. The circles are of unity amplitude and represent the locus of points that can be achieved by phase shifters 121 and 122, respectively. One circle is drawn at the origin o of the complex plane and the other circle is drawn about the desired weight value at point P. The intersections of the two circles determine the pair of phase shifts which will give the desired complex value. Inspection of the diagram shown in FIG. 7 reveals that the maximum allowed weight value is obtained when the phase circles just touch one another. This, of course, constitutes a sum of one. (It is recognized that the input power was divided by two and then combined; the input/output attenuation therefore is 0, assuming no loss through the hybrids, phase shifters and points of interconnection.)

Figure 8:
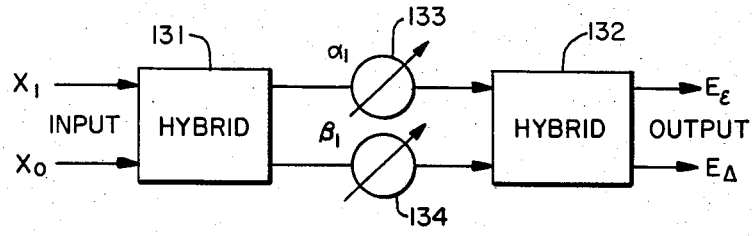
FIG. 8 shows a block diagram of the implementation of a variable directional coupler employing complex phase shifter/hybrid devices.

A variable directional coupler may be realized using magic Ts and ferrite phase shifters, as pointed out above in conjunction with the description of FIG. 4, using the block diagram interconnection arrangement shown in FIG. 8. Because the phase shifters are very low-loss ferrite devices (0.2 dB), they are rather insensitive to temperature variations. Phase shifters 133 and 134 are coupled between hybrids 131 and 132 as shown, with the input signals being applied on lines $x_1$ and $x_0$ to magic T 131, and output signals derived from hybrid 132 $E_\epsilon$ and $E_\Delta$ as shown.

The input/output relationship of the variable coefficient coupler illustrated in FIG. 8 is given by $$E_\epsilon = X_0\left(\frac{e^{j\alpha 0} - e^{j\beta 0}}{2}\right) + X_1\left(\frac{e^{j\alpha 0} + e^{j\beta 0}}{2}\right) \quad (1)$$

and $$E_\Delta = X_0\left(\frac{e^{j\alpha 0} + e^{j\beta 0}}{2}\right) + X_1\left(\frac{e^{j\alpha 0} - e^{j\beta 0}}{2}\right) \quad (2)$$

where $E_\epsilon$ and $E_\Delta$ are the respective sum and difference ports of the magic T hybrid. Simplifying with Euler's identities and defining new control parameters $\theta_0=\frac{1}{2}(\alpha_0-\beta_0)$ and $\phi_0=\frac{1}{2}(\alpha_0+\beta_0)$ yields $$E_\epsilon=X_0 \sin \theta_0 e^{j\phi 0+\pi/2}+X_1 \cos \theta_0 e^{j\phi 0} \quad (3)$$

and $$E_\Delta=X_0 \cos \theta_0 e^{j\phi 0}+X_1 \sin \theta_0 e^{j\phi 0+\pi/2} \quad (4)$$

The complex weight which is applied to each input (with respect to the sum port) canthen be defined as $$w_1=\sin \theta_0 e^{j\phi 0+\pi/2}$$

$$w_2=\cos \theta_0 e^{j\phi 0} \quad (5)$$

where it can easily be shown that $$|w_1|^2+|w_2|^2=1$$

and $$|w_1| \leqq 1 \quad (6)$$

Figure 9:
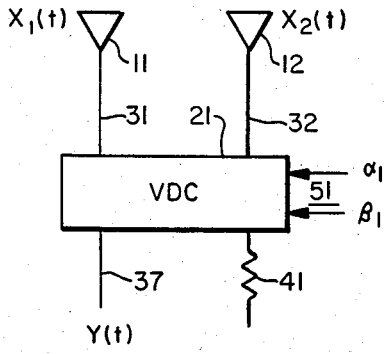
FIG. 9 is a block diagram of a two-antenna element adaptive array employing a single variable directional coupler.

FIG. 9 illustrates an individual two-element adaptive array using a single variable coefficient weight, for a portion of the antenna network shown in FIG. 1, specifically combining the outputs of antennas 11 and 12. A variable signal $X_i(t)$ represents a complex input signal from a respective one of antenna element 11 and 12. The output signal $E_\epsilon(t)$ is a weighted sum defined by equation (3) and is given by:

$$E_\epsilon(t)=X_0(t) \sin \theta_0 e^{j\phi 0+\pi/2}+X_2(t) \cos \theta_0 e^{j\phi 0} \quad (7)$$

The resultant output power of the array is given by $$|E_\epsilon E_\epsilon^*|=X_0X_0^* \sin^2 \theta_0+X_1X_2^* \cos^2 \theta_0+Re[X_1X_0^* e^{j\pi/2}]\sin 2\theta_0$$

where the asterisk (*) denotes the complex conjugate and Re[.] denotes the field of real numbers.

Figure 10:
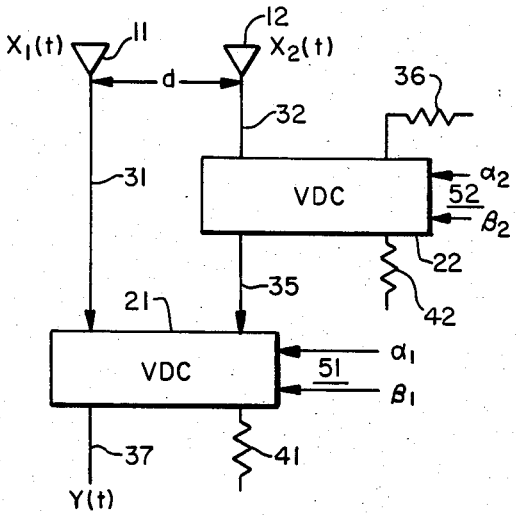
FIG. 10 is a block diagram of a two antenna element adaptive array employing a modified (dual) variable directional coupler arrangement.

Unfortunately, the phase shift weighting of the variable directional coupler is applied dependently to the output waveform and not independently to the inputs. In order to compensate for this inadequacy, a second variable directional coupler shown in FIG. 10, which has independent amplitude and phase control is added to the second antenna element 12. (In the cascaded arrangement of FIG. 1, this is simply the next highest variable directional coupler 22). Thus, the resultant output power of the modified minimal loss weighting/-combining network for the portion of the adaptive array of FIG. 1, illustrated in FIG. 10, is:

$$|E_\epsilon E_\epsilon^*|=X_0X_0^* \sin^2 \theta_0+X_2X_2^* \sin^2 \theta_1 \cos^2 \theta_0+Re[X_1X_0^* je^{j\phi 1}]\sin \theta_1 \sin^2 \theta_{10} \quad (8)$$

As can be seen from equation (8), the adaptive array has a sufficient number of degrees of freedom to reduce the noise interference of a single jammer. Applying this analysis to an m-element array shown in FIG. 11 (it being noted that m=4 for the array shown in FIG. 1) the following definition of the output voltage may be obtained:

$$E_\epsilon(t) = X_0(t)\sin\theta_0 e^{j\phi 1+\pi/2} + \cos\theta_0 e^{j\phi 1+\phi 2}(X_1(t)\sin\theta_1 e^{j\pi/2} + \cos\theta_1 e^{j\phi 3}(X_2(t)\sin\theta_2 e^{j\pi/2} + \ldots + \cos\theta_{m-1} e^{j\phi m}(X_m(t)\sin\theta_m e^{j\pi/2})\ldots) \quad (9)$$

Simplifying, by the use of vector notation, the effective weight amplitude functions, one obtains $$A(\theta) = \begin{bmatrix} \sin \theta_0 \\ \sin \theta_1 \cos \theta_0 \\ \sin \theta_2 \cos \theta_1 \cos \theta_0 \\ \sin \theta_m \prod_{l=0}^{m-1} \cos \theta_l \end{bmatrix} \quad (10)$$

and their phase functions by $$\psi(\phi) = \begin{bmatrix} \phi_0 + \pi/2 \\ \phi_0 + \phi_1 + \pi/2 \\ \phi_0 + \phi_1 + \phi_2 + \pi/2 \\ \phi_m + \frac{\pi}{2} + \sum_{l=0} \phi_l \end{bmatrix} \quad (11)$$

From equation 10, it can be seen that the amplitude functions are multiplicatively coupled in a manner which becomes increasingly more complex upon the addition of new antenna elements. These functions are also sinusoidal, so that they can indirectly affect the weight phase as $\theta$ passes through sequential zeroes of the sinusoidal function. Similarly, equation (11) shows that an additive coupling exists between each sequential phase function. As a result, an adjustment of the control parameters for the ith weight alters the amplitude and phase characteristics of all the weights for $l>i$.

The manner in which the control processor 25 supplies control voltages for the $\alpha_i$ and $\beta_i$ phase adjustment signals for each respective variable directional coupler is a two part optimization procedure. Each part utilizes specific gradient terms to optimally set the cascade network for achieving a global optimum solution. The interference process is constrained so as to always seek a solution which yields the maximum signal-to-noise improvement in the antenna array.

The initial phase of this control procedure analytically optimizes the combining process between the main beam signal and the collective sum of all jamming signals from the auxiliary channels. It should be noted that in a sidelobe canceller, only jamming signals can be received by the critically placed auxiliary feed systems. This algorithm, referred to above as a ratio gradient, is not a gradient follower, but is, instead, a direct calculation technique utilizing gradient information for setting the primary combiner. In general, this technique yields a local optimum unless the auxiliary combiners are also optimally set, in which case the local optimum is also global or universally optimum.

The objective of the ratio gradient procedure is to set only those control parameters which optimize the combiner. Therefore, the m-element array shown in FIG. 11 may be simplified to a two input adaptive system shown in FIG. 12. In FIG. 12, the antenna input Y(t) represents a weighted sum of all jamming signals in the auxiliary element channels. As in the foregoing analysis, the array output sum and difference power is given by $$E_\epsilon E_\epsilon^* = X_0 X_0^* \sin^2\theta_0 + YY^* \cos^2\theta_0 + C_{yx} \sin(\phi_1+\alpha) \sin 2\theta_0 \quad (12)$$

and $$E_\Delta E_\Delta^* = X_0 X_0^* \cos^2\theta_o + YY^* \sin^2\theta_0 - C_{yx} \sin(\phi_1+\alpha) \sin^2\theta_0 \quad (13)$$

In equations (12) and (13), $\theta_0$ and $\phi_1$ are the respective amplitude and phase functions to be optimized. The variables $C_{yx}$ and $\alpha$ represent the amplitude and phase terms resulting from the correlation between $X_0(t)$ and Y(t). It is to be observed that this correlation product only represents the jamming signals received by the array and is virtually independent of the desired signal present only as component of $X(t)=S_0(t)+N_0(t)$. Hence, desired signal degradation occurs only if it becomes necessary to attenuate the main beam waveform in order to achieve a desired cancellation effect.

The optimization process requires a simultaneous measurement (or averaging) of the sum and difference power. These measurements are employed to form a ratio (or modified) gradient. Formation of the ratio is very important for two reasons: first, gradient averaging time is enormously reduced, thus making the algorithm fast and, second, a normalized (thus gain and maximum jammer power level independent) algorithm results.

Considering the first advantage, modulation due to a dominant (non-nulled) jammer is present in both output ports and thus cancellable by factorization. This ratio can be simply expressed as a function of equations 12 and 13;

$$P_R = \left(\frac{P_\epsilon}{P_\Delta}\right)_- \left[\left(\frac{P_\Delta}{P_\epsilon}\right)_+ - \left(\frac{P_\Delta}{P_\epsilon}\right)_-\right] \quad (14)$$

where $$P_\epsilon = J_d[E_\epsilon E_\epsilon^* + E_\Delta E_{66}^*] \text{ and}$$
$$P_\Delta = J_d[E_\epsilon E_\epsilon^* - E_{66} E_{66}^*]$$

The + and − subscripts denote a + and − perturbation about the nominal value of each control parameter, respectively.

The variable $J_d(t)$ represents the level of (dominant) jammer modulation present in each of the output ports. The elimination of $J_d(t)$ in equation (14) requires a level of dominance to exist if factorization is to occur. The output voltage of the array in FIG. 12 may be represented by $$E_\epsilon(t) = V_s(t) + J_s(t)V_f(t) + J_d(t)V_d(t) \quad (15)$$

where $V_s(t)$, $V_f(t)$ and $V_d(t)$ denote the desired signal, weak jammer and dominant jamming signals, respectively. The dominance of $J_d(t)$ diminishes proportionally as $|J_d(t)|$ approaches $|J_s(t)|$. This simply indicates that additional degrees of freedom are required; they are provided by the upper elements of the cascade network and the amplitude phase search procedure.

It should be noted that when a single jammer signal is being suppressed, the processor is fully capable of optimizing the network in a single step. The correlation phase $\alpha$ can be calculated by $$\alpha = (\phi_1+\alpha)_{old} - \phi_1 \quad (16)$$

and the correlation magnitude $C_{yx}$ by $$P_c = \frac{\sin^2\theta_0 + \frac{1}{2}P_R(\theta_0)\cos^2\theta_0}{2\sin(\phi_1+\alpha)_{old}} \quad (17)$$

where $P_c = C_{yx}/P_{66}$. Now if $\theta_0$ is restricted to lie within the range $0 \leqq 0_0 \leqq \pi$, then an minimum solution to equation (12) will exist if the product $C_{yx} \sin(0_1+a)$ is is negative. This can be achieved by applying the following requirements:

$$\text{If } P_c \geqq 0 \quad (18)$$

$$\text{then } [\phi_1+\alpha]_{new} = -\pi/2$$

$$[\phi_1]_{new} = [\phi_1]_{old} - \pi/2 - [\phi_1+\alpha]_{old}$$

-continued $$\text{if } P_c < 0 \tag{19}$$

$$\text{then } [\phi_1 + \alpha]'_{old} = [\phi_1 + \alpha]_{old} + \pi$$

$$[\phi_1]_{new} = [\phi_1]_{old} - \pi/2 - \{(\phi_1 + \alpha)_{old} + \pi\}'_{old}$$

$$[\phi_1]_{new} = [\phi_1]_{old} + \pi/2 - [\phi_1 + \alpha]_{old}.$$

Then the optimum angle, $[\theta_0]_{new}$ is given by $$\text{Tan } 2\theta_0 = \frac{[2\sin^2\theta_0 + P_R(\theta_0)\cos^2\theta_0]\sin(\phi_1 + \alpha)_{new}}{[2\cos^2\theta_0 - P_R(\theta_0)\sin^2\theta_0]\sin(\phi_1 + \alpha)_{old}} \tag{20}$$

To ensure that $\theta_0$ remains in the proper range, equation 20 is restricted in the following way:

$$\text{Tan } 2\theta_0 = \frac{|2\sin^2\theta_0 + P_R(\theta_0)\cos^2\theta_0|}{|(2\cos^2\theta_0 - P_R\sin^2\theta_0)\sin(\phi_1 + \alpha)_{old}} \tag{21}$$

The ratio gradient (RG) for simple power surpression will now be discussed. The explanation of this procedure is followed by a ratio gradient signal to noise maximization process (RGM) derivation.

From FIG. 12, the output sum and difference power is given by $$E_\epsilon E_\epsilon^* = X_0X_0^* \sin^2\theta_0 + YY^* \cos^2\theta_0 + C_{yx} \sin(\phi_1+\alpha) \sin 2\theta_0 \tag{22}$$

and $$E_{66}E_{66}^* = X_0X_0^* \cos^2\theta_0 + YY^* \sin^2\theta_0 - C_{yx} \sin(\phi_1+\alpha) \sin 2\theta_0 \tag{23}$$

Equations (22) and (23) are seen to contain four unknowns, $X_0X_0^*$, $YY^*$, $C_{yx}$ and $\alpha$. By taking partial derivatives of equations (22) and (23) with respect to $\theta_0$ and $\phi_1$ (which are, of course, known variable directional coupler control quantities), the necessary form independent equations can be obtained. The sum port power can then be adjusted for either minimum power or signal-to-noise maximization in a direct application of new values for $\theta_0$ and $\theta_1$ which optimize equation (22).

Partial differentiation with respect to the control parameters $\theta_0$ and $\theta_1$ yields:

$$(2P_\epsilon/2\theta_0) = -2(YY^* - X_0X_0^*) \sin 2\theta_0 + 4C_{yx} \sin(\phi_1+\alpha) \cos 2\theta_0 \tag{24}$$

and $$(2P_\Delta/2\theta_1) = 2C_{yx} \cos(\phi_1+\alpha) \sin 2\theta_0 \tag{25}$$

Combining equations (22)–(25) yields $$(YY^* - X_0X_0^*) = P_{66} \cos 2\theta_0 - \tfrac{1}{2}(2P_\Delta/2\theta_0) \sin 2\theta_0 \tag{26}$$

Then dividing equation (26) by (27) and substituting equation (26) yields $$\text{Tan}(\phi_1 + \alpha)_{old} = \frac{\sin^2\theta_0[2\sin^2\theta_0 + P_R(\theta_0)\cos^2\theta_0}{2P_R(\phi_1)} \tag{27}$$

where $$P_R(\phi_1) = \frac{1}{P\Delta} \frac{\partial P\Delta}{\partial \phi_1} \text{ and } P_R(\theta_0) = \frac{1}{P\Delta} \frac{\partial P\Delta}{\partial \theta_0}.$$

If equation (26) is now substituted into equation (23), the correlation magnitude $C_{yx}$ is given by the expressions $$C_{yx} = \frac{P\Delta - (YY^* - X_0X_0^*)\cos^2\theta_0}{2\sin(\phi_1 + \alpha)_{old}\sin^2\theta_0} \tag{28}$$

and $$\frac{C_{yx}}{P\Delta} = \frac{\sin^2\theta_0 + \tfrac{1}{2}P_R(\theta_0)\cos^2\theta_0}{2\sin(\phi_1 + \alpha)_{old}}$$

Now, assuming a min/max solution for equation (22), the substitution of equation (22) and (28) into equation (24) yields $$\text{Tan}2\theta_0 = \frac{2C_{yx}\sin(\phi_1 + \alpha)_{new}}{(YY^* - X_0X_0^*)} = \frac{[2\sin^2\theta_0 + P_R(\theta_0)\cos^2\theta_0]\sin(\phi_1 + \alpha)_{new}}{[2\cos^2\theta_0 - P_R(\theta_0)\sin^2\theta_0]\sin(\phi_1 + \alpha)_{old}}. \tag{29}$$

Since $(YY^* - X_0X_0^*)$ can assume both + and − values, $$\text{Tan}2\theta_0 = \frac{|2\sin^2\theta_0 + P_R(\theta_0)\cos^2\theta_0)|}{-|\{2\cos^2\theta_0 - P_R(\phi_0)\sin^2\theta_0\}\sin(\phi_1 + \alpha)_{old}|} \tag{30}$$

where $|:|$ denotes the absolute value.

Figure 13:
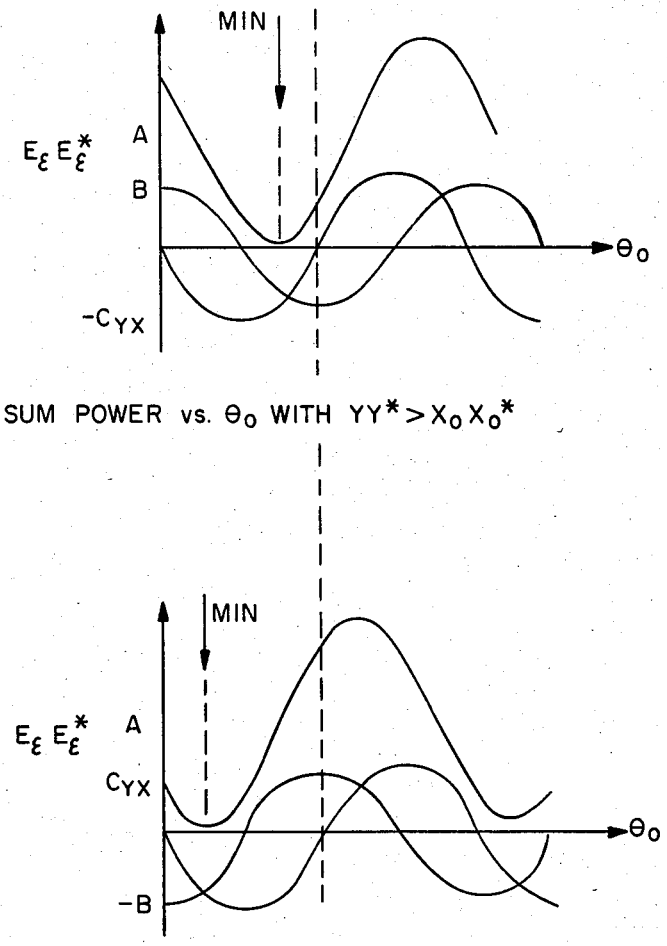
FIG. 13 shows a pair of graphs representing the variation of sum power vs. phase angle.

FIGS. 11*a* and 11*b* depict graphically how $(YY^* - X_0X_0^*)$ effects the quadrant orientation and min/max solutions. Expanding equation (22), FIG. 13 illustrates that $\theta_0$ must be restricted to the range $0 \leqq \theta \leqq 180°$, i.e.

$$E_\epsilon E_\epsilon^+ = \underbrace{\tfrac{1}{2}(X_0X_0^* + YY^*)}_{A} + \underbrace{\tfrac{1}{2}(YY^* - X_0X_0^*)\cos 2\theta - Cyx \sin 2\theta}_{B}. \tag{31}$$

Figure 11:
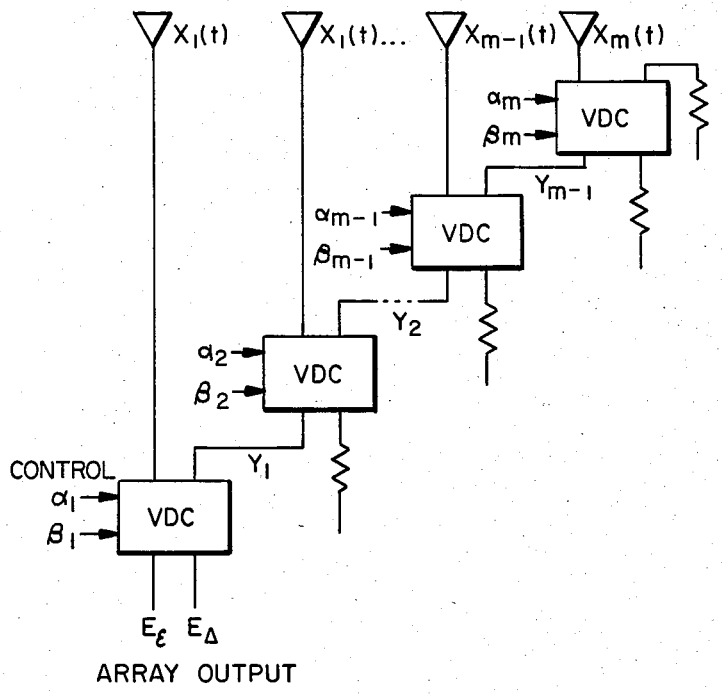
FIG. 11 is a schematic block diagram of an m-element cluster of auxiliary feed elements and associated low-loss weighting and combining variable directional couplers.
Figure 12:
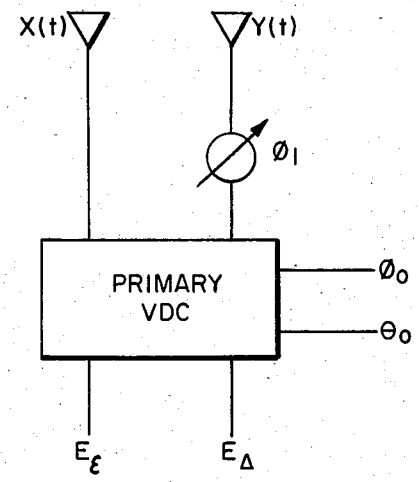
FIG. 12 schematically illustrates a simplified model of an m-element array of FIG. 11.

The upper elements of the cascade, shown in FIG. 11, referenced previously, are adjusted by using an amplitude phase search procedure. Amplitude (or phase) of each variable directional coupler is independently perturbed by an amount $\delta_i$ (the value of which is specified below). This adjustment temporarily destroys the local optimization achieved by the ratio gradient procedure at the primary combiner.

At this point, the ratio gradient procedure is reapplied and the quality of the resulting new local optimization is compared with the local optimization before $\delta_i$ was applied. If the new local optimization is better, the algorithm progresses to the next control parameter weight and repeats the process. Otherwise, $-\delta_i$ is applied and the local optimization rechecked. Theoretically, $-\delta_i$ will improve the result if $+\delta_i$ did not, providing that either the electromagnetic environment did not change or that the control value produced by processor 25 is optimally set. Therefore, if the new local optimization is worse than the old unperturbed value, the old value is restored (the weight unchanged) and the processor progresses to the next control parameter.

The amplitude-phase search procedure therefore adjusts the upper cascade variable directional couplers in a coordinated way with the primary variable directional coupler. This process can be shown to be equivalent to setting the gradient of the output power with respect to the several controls equal to zero. Zero gradient, in turn, is the condition required for a global or universal least-mean-squares optimum solution.

An important aspect of the amplitude phase search procedure portion of the algorithm is the calculation of the perturbation $\delta_i$. Since both sum and difference port power measurements are available, null depth (N) can be determined. Furthermore, with "n" bits of variable directional coupler phase shifter control, bit precision limit to null depth ($N_b$) may be defined as $$N_b = 20 \log (2^N/2\pi) dB \tag{32}$$

A comparison of N with $N_b$ yields the bit level which is currently significant in the solution. Therefore, $\delta_i$ is perturbed or searched at this level. This searches the weight space at a rate which is a maximum given that minimal degradation of the current solution is to be caused by the search process. As N increases, $\delta_i$ smoothly decreases according to equation 32 as the square root of N until the least significant bit of the weights is being searched. This is, then, the optimum solution vector.

For many sidelobe canceller applications, the ratio gradient procedure (a power minimization process) is adequate, i.e. for a weak desired signal with respect to interference. Optimization of the signal-to-noise ratio, however, is required in many applications. The following explanation shows how the signal-to-noise ratio is maximized in a sidelobe canceller application. Modification of this procedure to incorporate independently-obtained signal power measurements (such as would be available from a modem) is more complicated.

The voltage $X_0(t)$ from the main feed form is composed of signal and noise (including interference) components. Generally, $$X_0(t) = S_0(t) + N_0(t). \tag{33}$$

The voltage of y(t) as defined in FIGS. 11 and 12 is to devoid of signal due to the critically placed auxiliary array elements, so that the correlation of x(t) with y(t), $C_{xy}$, is dependent only upon noise correlation. Namely, $$C_{xy} = E\{X_0(t) Y(t)^*\} = E\{N_0(t) Y(t)\} \tag{34}$$

where {} denotes expected value. As a result, interference power in the sum port output continues to be minimized with the value of $\phi_1$ obtained by the ratio gradient calculations since $C_{xy}$ is not a function of the desired signal. There remains to be determined an optimal amplitude weight $A_0$ which is a function of the desired signal. The identifying signal (Pes) and noise (Pen) terms may be employed to yield the expressions $$P_{ZS} = S_0 S_0^* \sin^2 \theta_0 \tag{35}$$

and $$P_{ZN} = N_0 N_0^* \sin^2 \theta_0 + X^* Y \cos^2 \theta_0 + C_{yx} \sin (\phi_1 + \alpha) \sin 2 \phi_0 \tag{36}$$

The noise to signal ratio may then be determined and minimized (thus maximizing signal-to-noise ratio) to obtain:

$$N/S + \frac{N_0 N_0^*}{S_0 S_0^*} + \frac{y^* y}{S_0 S_0^* \tan^2 \theta_0} + + \frac{C_{xy}}{S_0 S_0^*} \sin(\phi_1 + \alpha) 2 \frac{\sin\theta_0 \cos\theta_0}{\sin^2 \theta_0} \tag{37}$$

N/S is minimized by setting $(2(N/S)/2\theta.) = 0$. Using the fact that the minimum N/S occurs at the same value of $\theta_0$ as the minimum value of S+N/S, there is obtained the expression $$(YY^*/\tan \theta_0) + C_{yx} \sin (\phi_1 + \alpha) = 0 \tag{38}$$

so that $$\tan \theta_0 = (-YY^*/C_{yx} \sin (\phi_1 + \alpha) \tag{39}$$

Thus, measurements made for the ratio gradient process are sufficient for use in equation (39), so that the measurements and calculation process described therefore is valid for the ratio gradient maximization procedure as well.

As will be appreciated from the foregoing explanation of the generation of control signals for optimizing the weighting values, supplied by the variable directional couplers, by using sum and different port power information, the processor is capable of carrying out a very rapid adaptive process referenced above as a ratio gradient process. This process is capable of nulling dominant jammers in a single step. Global or universal optimization of the system output will proceed more slowly and is accomplished by adjustment of the auxiliary array coupled with continual readjustment of the final low loss weight by the ratio procedure. Calculations for this nulling are carried out by the processor 25 and the outputs from the processor supplied over links 51–54 for the low loss combining and weighting network driver through D to A converters.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What is claimed is:

1. For use in antenna system having a principal feed element and a reflector arrangement for directing energy to said principal feed-element, an auxiliary system for controlling the response pattern of said system comprising:

a plurality of auxiliary feed elements, disposed adjacent to said principal feed element;

first means, coupled to the signal output paths from said auxiliary feed elements, for selectively weighting and combining the outputs of said auxiliary feed elements;

second means, coupled to said first means and to said principal feed element, for selective combining and weighting the output of said first means and the output of said principal feed element; and third means, coupled to said first and second means, for monitoring the output of said second means and controlling the selective weighting and combining action of said first means in response thereto.

2. An auxiliary system according to claim 1, wherein said plurality of auxiliary feed elements are disposed around said principal feed element but are offset therefrom along the axis of said principal feed element.

3. An auxiliary system according to claim 1, wherein said first means comprises a plurality of low-loss cascaded weighting and combining networks operating in the frequency range in which said auxiliary feed elements operate.

4. An auxiliary system according to claim 1, wherein said first means comprises a plurality of low-loss cascaded weighting and combining networks operating directly in the radio-frequency range.

5. An auxiliary system according to claim 4, wherein said second means comprises a further low-loss weighting and combining network coupled to an output of the last one of the cascaded networks of which said first means is comprised and to the output of said prinicpal feed element, said further network operating directly in the radio-frequency range.

6. An auxiliary system according to claim 3, wherein each of said networks comprises a variable directional coupler.

7. An auxiliary system according to claim 6, wherein said variable directional coupler comprises a pair of phase shift devices coupled between a set of matched signal splitting and combining networks, the phase shifts imparted by said phase shift devices being controlled by said third means.

8. An auxiliary system according to claim 7, wherein the operation of said phase shift devices are offsetable from each other.

9. An auxiliary system according to claim 5, wherein said reflector arrangement includes a principal reflector and a subreflector, said principal and auxiliary feed elements being aimed toward said subreflector, and said auxiliary feed elements being positioned so as to defocus said auxiliary feed elements relative to said principal feed element.

10. An auxiliary system according to claim 1, further including means disposed in the output signal path of said principal feed element, for selectively by-passing said second means and thereby coupling the output of said principal feed directly to a signal output port.

11. An antenna system comprising:

a primary feed element;

a reflector arrangement for directing energy to said primary feed element;

a plurality of secondary feed elements disposed adjacent to said primary feed element;

a plurality of low-loss cascaded weighting and combining networks coupled to the outputs of said secondary feed elements for controllably weighting and combining said outputs, the last one of said cascaded networks producing an output signal;

first means for controllably combining and weighting said output signal and the output of said primary feed element; and second means, coupled to said cascaded networks and first means, for controlling the selective weighting and combining action of said plurality of low-loss cascaded weighting and combining networks and said first means in accordance with the output of said first means.

12. An antenna system according to claim 11, wherein said secondary feed elements are arranged in a cluster around said primary feed element.

13. An antenna system according to claim 12, wherein said reflector arrangement includes a principal reflector and a subreflector, said primary feed element being disposed at the focus of said reflector arrangement and said secondary feed elements being positioned so as to defocus said secondary feed elements relative to said primary feed element.

14. An antenna system according to claim 11, wherein said first means comprises a further low-loss weighting and combining network coupled to an output of said last one of said plurality of cascaded networks and to the output of said principal feed element, and wherein each of said networks operates directly to the frequency range of operation of said feed elements.

15. An antenna system according to claim 14, wherein said frequency range is the RF range.

16. An antenna system according to claim 14, wherein each of said networks comprises a variable directional coupler.

17. An antenna system according to claim 16, wherein said variable directional coupler comprises a pair of phase shift devices coupled between a set of matched signal splitting and combining networks, the phase shifts imparted by said phase shift devices being controlled by said second means.

18. An antenna system according to claim 17, wherein the operation of said phase shift devices are offsetable from each other.

19. An antenna system according to claim 11, wherein said second means includes means for controlling the selective weighting and combining action of said networks so as to modify the response of said antenna system.

20. An antenna system according to claim 11, wherein said second means includes means for controlling the weighting and combining action of said networks so as to selectively effect sidelobe cancellation from the response pattern of said antenna system.

21. An antenna system according to claim 11, wherein said second means includes means for controlling the weighting and combining action of said networks so as to effectively null a selected portion of the response pattern of said antenna system and thereby substantially eliminate the impact of jamming radiation in said portion of said pattern.

22. A signal combining network comprising a first input port;

a plurality of second input ports;

first means, coupled to said plurality of second input ports, for selectively weighting and combining signals coupled thereto;

second means, coupled to said first means and to said first input port, for selectively combining and weighting the output of said first means and a signal coupled to said first input port; and third means, coupled to said first and second means, for monitoring the output of said second means and controlling the selective weighting and combining action of said first means in response thereto.

23. A signal combining network according to claim 22, wherein said third means includes means for controlling the selective weighting and combining action of said first and second means in response to the output of said second means.

24. A signal combining network according to claim 23, wherein said first means comprises a plurality of low-loss cascaded weighting and combining networks.

25. A signal combining network according to claim 24, wherein said second means comprises a further low-loss weighting and combining network coupled to an output of the last one of the cascaded networks of which said first means is comprised and to said first input port.

26. A signal combining network according to claim 25, wherein each of said networks comprises a variable directional coupler.

27. A signal combining network according to claim 26, wherein said variable directional coupler comprises a pair of phase shift devices coupled between a set of matched signal splitting and combining networks, the phase shifts imparted by said phase shift devices being controlled by said third means.

28. A signal combining network according to claim 27, wherein the operation of said phase shift devices are offsetable from each other.

29. A signal combining network according to claim 23, wherein said third means includes means for effecting complex adjustment of the effective weighting action of said first and second means.

30. A signal combining network according to claim 23, wherein said third means includes means for optimizing the weighting and combining action of said first and second means in accordance with the effective impact of said network on a prescribed characteristic of signals applied to said input ports.

31. A signal combining network according to claim 30, wherein said third means includes means for optimizing the adjustment of amplitude and phase weighting action of said first and second means.

32. A signal combining network according to claim 23, wherein said first input port is adapted to be coupled to the primary feed of an antenna system and said second input ports are adapted to be coupled to respectively secondary input feeds to said antenna system.

33. A signal combining network according to claim 32, wherein said secondary input feeds are offset from said primary input feed so as to be defocussed relative to said primary input feed.

34. A signal combining network according to claim 33, wherein said third means includes means for effecting complex adjustment of the effective weighting action of said first and second means.

35. A signal combining network according to claim 34, wherein said third means includes means for optimizing the adjustment of amplitude and phase weighting action of said first and second means.

36. An auxiliary system according to claim 1, wherein said second means comprises a low-loss weighting and combining network having a first input coupled to an output of said first means, a second input coupled to the output of said principal feed element, and a difference output port to which said third means is coupled.

37. An auxiliary system according to claim 36, wherein said low-loss weighting and combining network further has a sum output port to which said third means is coupled.

38. An antenna system according to claim 11, wherein said first means comprises a further low-loss weighting and combining network having a first input coupled to receive the output signal produced by said last one of said cascaded networks, a second input coupled to the output of said primary feed element, and a difference output port to which said second means is coupled.

39. An antenna system according to claim 38, wherein said further low-loss weighting and combining network further has a sum output port to which said second means is coupled.

40. A method according to claim 30, wherein said further low-loss weighting and combining network has a difference output port from which said second output signal is derived.

41. A method according to claim 40, wherein said further low-loss weighting and combining network has a sum output port from which said second output signal is further derived.

42. A signal combining network according to claim 22, wherein said second means comprises a low-loss weighting and combining network having a first input coupled to an output of said first means, a second input coupled to said first input port, and a difference output port to which said third means is coupled.

43. A signal combining network according to claim 42, wherein said low-loss weighting and combining network further has a sum output port to which said third means is coupled.

44. For use in an antenna system having a primary feed element and a reflector arrangement for directing energy relative to said primary feed element, a method of controlling the energy response characteristic of said antenna system comprising the steps of (a) disposing a plurality of secondary feed elements adjacent to said primary feed element such that said plurality of secondary feed elements are defocussed relative to said primary feed element; and controllably combining the signal feed links for said primary and secondary feed elements by (b1) selectively weighting and combining the outputs of said secondary feed elements to produce a first output signal, (b2) selectively weighting and combining said first output signal and the output of said primary feed element to produce a second output signal, and (b3) monitoring said second output signal and controlling the steps (b1) and (b2) in response thereto.

45. A method according to claim 44, wherein step (b1) comprises applying the outputs of said secondary feed elements to a plurality of low loss cascaded weighting and combining networks to produce said first output signal.

46. A method according to claim 45, wherein step (b2) comprises applying said first output signal and the output of said primary feed element to a further low loss weighting and combining network to produce therefrom said second output signal.

47. A method according to claim 46, wherein each of said networks comprises a variable directional coupler.

48. A method according to claim 35, wherein said variable directional coupler comprises a pair of phase shift devices coupled between a set of matched signal splitting and combining networks, and step (b3) comprises controlling the phase shifts imparted by said phase shift devices in response to said monitored second output sign.

49. A method according to claim 44, wherein step (b3) comprises controlling the weighting and combining carried out in steps (b1) and (b2) so as to effectively null a selected portion of the energy response characteristic of said antenna system and thereby substantially eliminate the impact of jamming radiation in said selected portion of said energy response characteristic.

* * * * *